US008141749B2

(12) United States Patent
Lin

(10) Patent No.: US 8,141,749 B2
(45) Date of Patent: Mar. 27, 2012

(54) FOAM SOAP DISPENSER CONTROL VALVE

(76) Inventor: Po-Hui Lin, Taipei (TW)

( * ) Notice: Subject to any disclaimer, the term of this patent is extended or adjusted under 35 U.S.C. 154(b) by 543 days.

(21) Appl. No.: 12/320,221

(22) Filed: Jan. 22, 2009

(65) Prior Publication Data

US 2010/0181342 A1 Jul. 22, 2010

(51) Int. Cl.

| | |
|---|---|
| ***B67D 7/76*** | (2010.01) |
| *B67D 7/06* | (2010.01) |
| *B65D 88/54* | (2006.01) |
| *F16K 15/00* | (2006.01) |

(52) U.S. Cl. ..... 222/190; 222/181.3; 222/321.3; 222/321.7; 222/321.8; 137/539; 137/539.5

(58) Field of Classification Search ..... 222/207, 222/321.7, 321.8, 321.9, 181.2, 181.3, 321.1, 222/321.3, 190; 137/539, 539.5
See application file for complete search history.

(56) References Cited

U.S. PATENT DOCUMENTS

| | | | | |
|---|---|---|---|---|
| 1,177,831 | A * | 4/1916 | Taylor et al. | 137/480 |
| 1,280,643 | A * | 10/1918 | Benjamin | 123/25 L |
| 1,554,127 | A * | 9/1925 | Roberts | 137/315.33 |
| 4,130,224 | A * | 12/1978 | Norman et al. | 222/207 |
| 4,394,938 | A * | 7/1983 | Frassanito | 222/207 |
| 4,546,904 | A * | 10/1985 | Frassanito | 222/214 |
| 5,501,372 | A * | 3/1996 | Daansen | 222/207 |
| 6,142,338 | A * | 11/2000 | Pellicano | 222/1 |
| 7,004,356 | B1 * | 2/2006 | Sayers | 222/137 |
| 7,780,039 | B2 * | 8/2010 | Criswell et al. | 222/108 |
| 2005/0284887 | A1 * | 12/2005 | Lewis et al. | 222/181.3 |
| 2007/0119864 | A1 * | 5/2007 | Tsai | 222/137 |
| 2009/0101671 | A1 * | 4/2009 | Cittadino et al. | 222/23 |

* cited by examiner

*Primary Examiner* — Kevin P Shaver
*Assistant Examiner* — Nicholas Weiss
(74) *Attorney, Agent, or Firm* — Rosenberg, Klein & Lee

(57) ABSTRACT

An improved assembly of a foam soap dispenser control valve includes a lower casing, an upper casing and a valve body. In addition, a spring is installed in a protruding tube of the valve body, and a steel ball is disposed at the tip of the spring, and a bushing is sheathed onto the external periphery of the protruding tube for abutting the steel ball tightly against the top of the protruding tube and the internal side of the upper edge of the bushing, and a hollow joint bushing is protruded from the top of the upper casing, and the top of the joint bushing is a closed end, and a soap feeding inlet is disposed on a side of the bottom of the joint bushing, such that the upper casing and the lower casing can be engaged by screws to form the improved assembly of the soap dispenser control valve.

1 Claim, 6 Drawing Sheets

FOAM SOAP DISPENSER CONTROL VALVE

BACKGROUND OF THE INVENTION

1. Field of the Invention

The present invention relates to an improved structural design of a press type foam soap dispenser control valve, and more particularly to a manual press type foam soap dispenser valve installed at a bathroom or a washing sink for supplying an appropriate quantity of liquid hand soap as a foam when the soap dispenser is pressed.

2. Description of the Related Art

At present, a traditional foam soap dispenser mounted in a bathroom or at a washing sink as shown in FIG. 1 generally comes with an assembly of a hollow box, having a control valve 12 installed at the bottom of the interior of the hollow box, and a press plate 11 installed at the front of the bottom of the hollow box and provided for manually pressing the control valve 12. The traditional foam soap dispenser is generally installed in the hollow box at an upper end of the control valve 12 for installing an inverted bag of liquid hand soap (not shown in the figure), such that when a user pulls or presses the press plate 11 to squeeze the control valve 12, the control valve 12 is used for supplying an appropriate quantity of liquid hand soap as a foam.

The traditional assembly of a foam soap dispenser control valve 12 as shown in FIGS. 2 and 3 comprises a lower casing 13, an upper casing 14 and a valve body 16, wherein the lower casing 13 is in a hollow cylindrical shape, and includes a diversion tube 21 at the middle of the lower casing 13 and an internal threaded section 131 on the internal side of the top of the lower casing 13; the upper casing 14 is a hollow cylindrical shape, and includes an external threaded section 141 at the external side of the bottom of the upper casing 14; and the valve body 16 is a hollow cylinder, and includes an extending tube 18 at the middle of the valve body 16, and a protruding tube 17 at the tip of the extending tube, and an end of the spring 22 is passed into the diversion tube 21, and a propping element 23 is passed through the tip of the spring 22, and a steel ball 24 is contained in the extending tube 18 of the valve body 16 and disposed at the lower edge of the middle of the protruding tube 17, such that the resilience of the spring 22 props the propping element 23 upward to support the steel ball 24 at the lower edge of the middle of the protruding tube 17, and a leakproof washer 15 is sheathed onto the bottom edge of the external periphery of the valve body 16. The upper casing 14 and the lower casing 13 are engaged with each other by screws to form the assembly of the control valve 12.

When the traditional foam soap dispenser 10 is used, a user presses the press plate 11 to push the diversion tube 21 in the control valve 12 to ascent and squeeze a liquid hand soap out from the soap dispenser in the form of a foam 10. When the diversion tube 21 is pushed upward, the spring 22 will be compressed to prop the propping element 23 to support the steel ball 24. Due to the gravity of the steel ball 24 and the propping element 23, the steel ball 24 cannot fully cover the lower edge of the middle of the protruding tube 17 during the pressing process, so that the liquid hand soap keeps dropping out continuously and causing unnecessary waste.

In view of the foregoing shortcomings of the prior art, the inventor of the present invention, based on years of experience in the related industry and following extensive research and experiments, has developed a foam soap dispenser control valve in accordance with the present invention to overcome the shortcomings of the prior art.

SUMMARY OF THE INVENTION

Therefore, it is the primary objective of the present invention to provide an improved assembly of a foam soap dispenser control valve comprising a lower casing, upper casing and a valve body, characterized in that a spring is installed in the protruding tube of the valve body, and a steel ball is installed at the tip of the spring, and a hollow bushing is sheathed onto the external periphery of the protruding tube, such that the steel ball abuts tightly against the top of the protruding tube and on the internal side of the upper edge of the bushing, and a hollow joint bushing is protruded from the top of the upper casing, and the joint bushing is a closed end, and a soap feeding inlet is disposed on a side of the bottom of the joint bushing, and a leakproof washer is sheathed onto the bottom of the external periphery of the valve body for connecting the upper casing and the lower casing by screws to form the improved assembly of the foam soap dispenser control valve.

To make it easier for our examiner to understand the objects, advantages and performance of the present invention, we use preferred embodiments with related drawings for the detailed description of the present invention as follows.

With reference to FIG. 4, the foam soap dispenser 30 is a hollow box having a control valve 32 installed at the bottom of the interior of the hollow box and a press plate 31 installed at a front end of the bottom of the hollow box.

With reference to FIGS. 5 and 6, the control valve 32 comprises a lower casing 33, an upper casing 34 and a valve body 36.

The lower casing 33 is in a hollow cylindrical shape, and includes an internal threaded section 331 disposed on the internal side of the top of the lower casing 33.

The upper casing 34 is in a hollow cylindrical shape, and includes an external threaded section 341 disposed at the external side of the bottom of the upper casing 34, a hollow joint bushing 342 protruded from the top of the upper casing 34, and the top of the joint bushing 342 being a closed end, and a soap feeding inlet 343 disposed on a side of the bottom of the joint bushing 342.

The valve body 36 is in a hollow cylindrical shape, and includes an extending tube 38 at the middle of the valve body 36, and a protruding tube 37 protruded from the top of the extending tube 38. Each component of the valve body 36 of the invention is technically equivalent to the prior art (not shown in the figure). Similarly, a spring is passed into the diversion tube, and the propping element is passed through the tip of the spring, and the steel ball is contained in the extending tube 38 of the valve body 36, and the protruding tube 37 is disposed at the lower edge of the middle of the protruding tube 37, such that the resilience of the spring props the propping element upward to support the steel ball at the lower edge of the middle of the protruding tube 37.

The present invention is characterized in that the valve body 36 includes a spring 41 installed in the protruding tube 37, a steel ball 42 disposed at the tip of the spring 41, a hollow penetrating bushing 43 sheathed onto the periphery of the protruding tube 37 for propping the steel ball 42 to prop the top of the protruding tube 37 and the internal side of the top of the bushing 43 tightly for sheathing a leakproof washer 35 onto the lower edge of the periphery of the valve body 36, and the upper casing 34 and the lower casing 33 are engaged with each other by screws to form the improved assembly of the foam soap dispenser control valve.

DETAILED DESCRIPTION OF THE PREFERRED EMBODIMENTS

Figure 1:
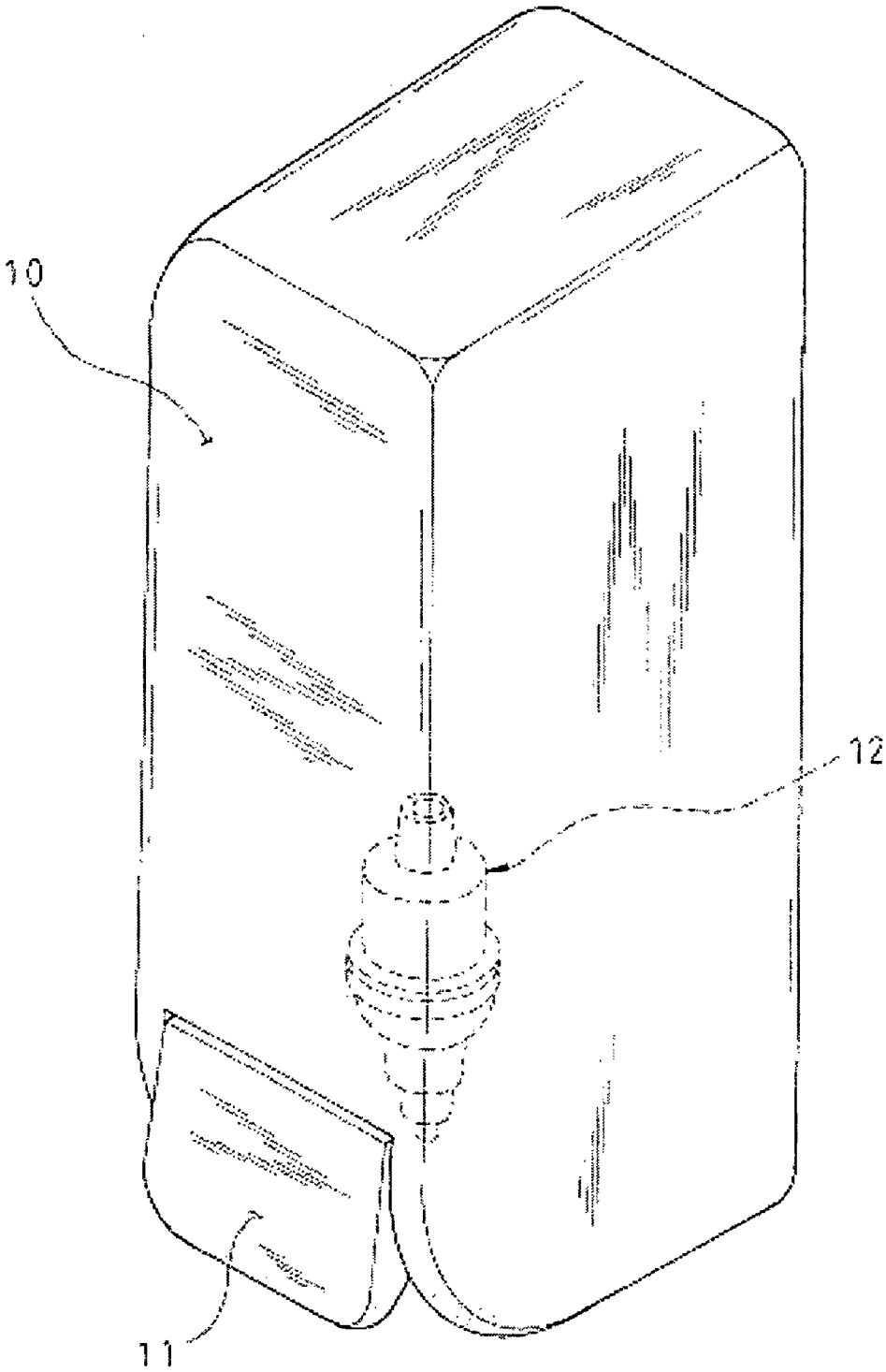
FIG. 1 (PRIOR ART)
FIG. 1 is a schematic view of an assembly of a traditional foam soap dispenser 10.
Figure 2:
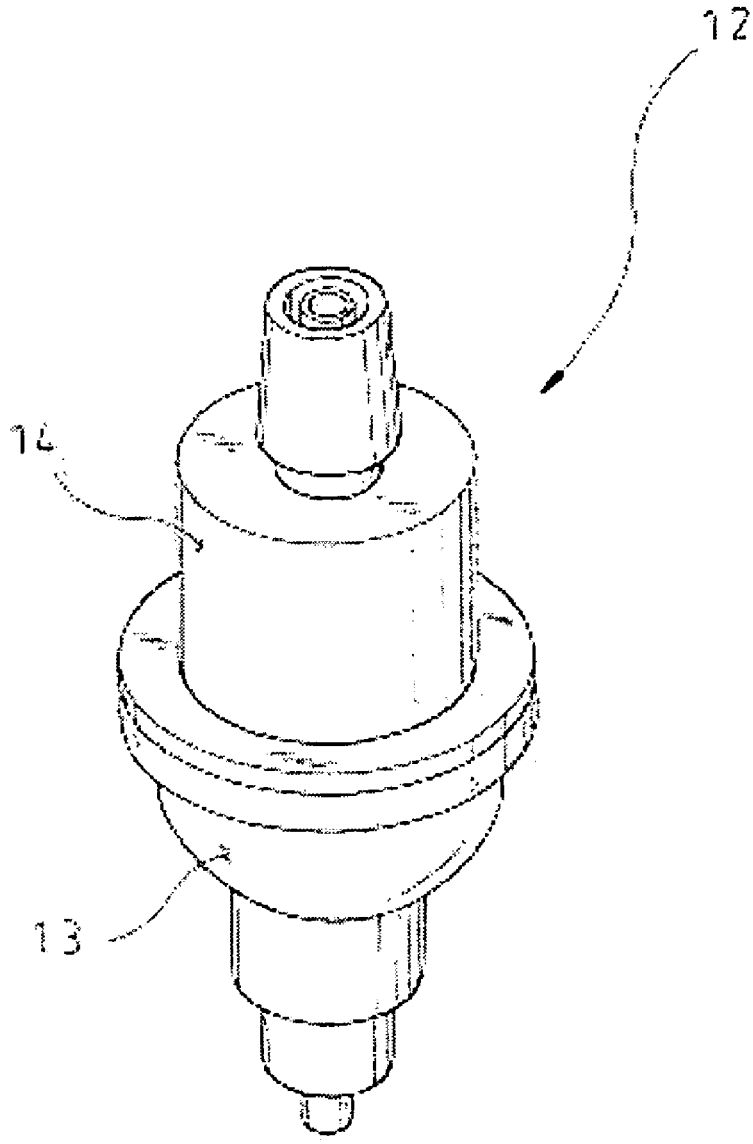
FIG. 2 (PRIOR ART)
FIG. 2 is a perspective view of a traditional control valve 12.
Figure 3:
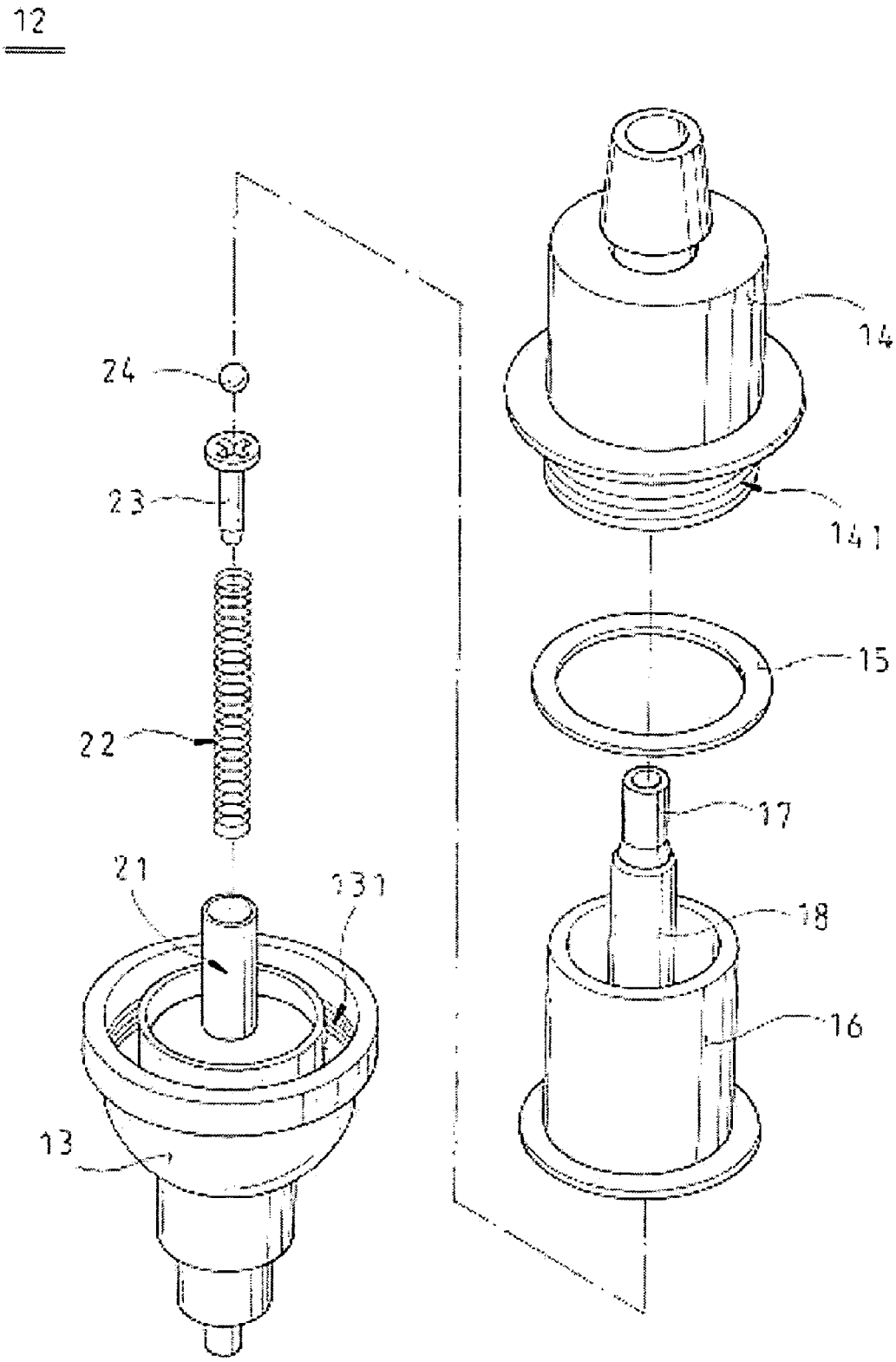
FIG. 3 (PRIOR ART)
FIG. 3 is an exploded view of a traditional control valve 12.
Figure 4:
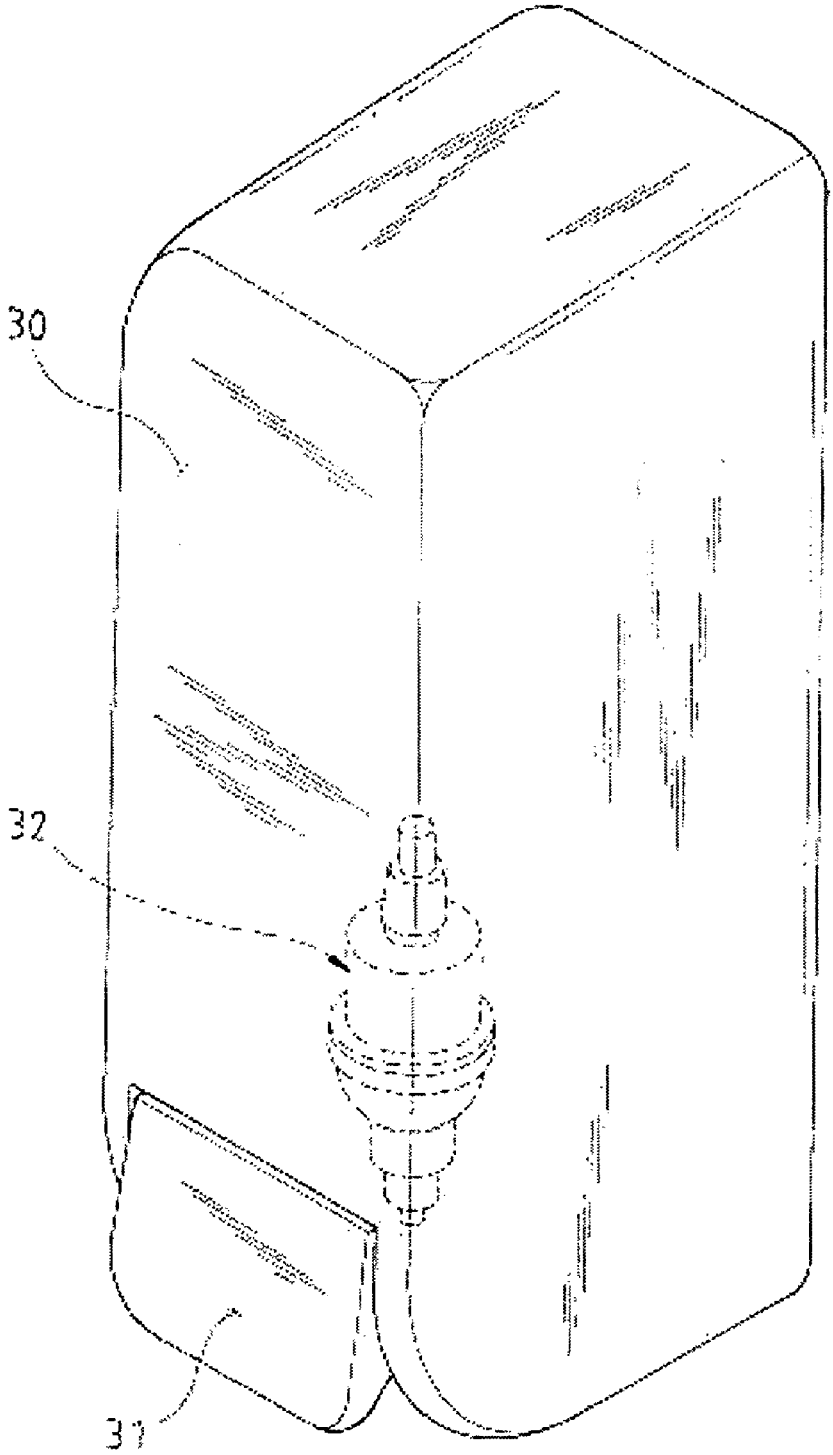
FIG. 4 is a schematic view of an assembly of a foam soap dispenser 30 in accordance with the present invention.
Figure 5:
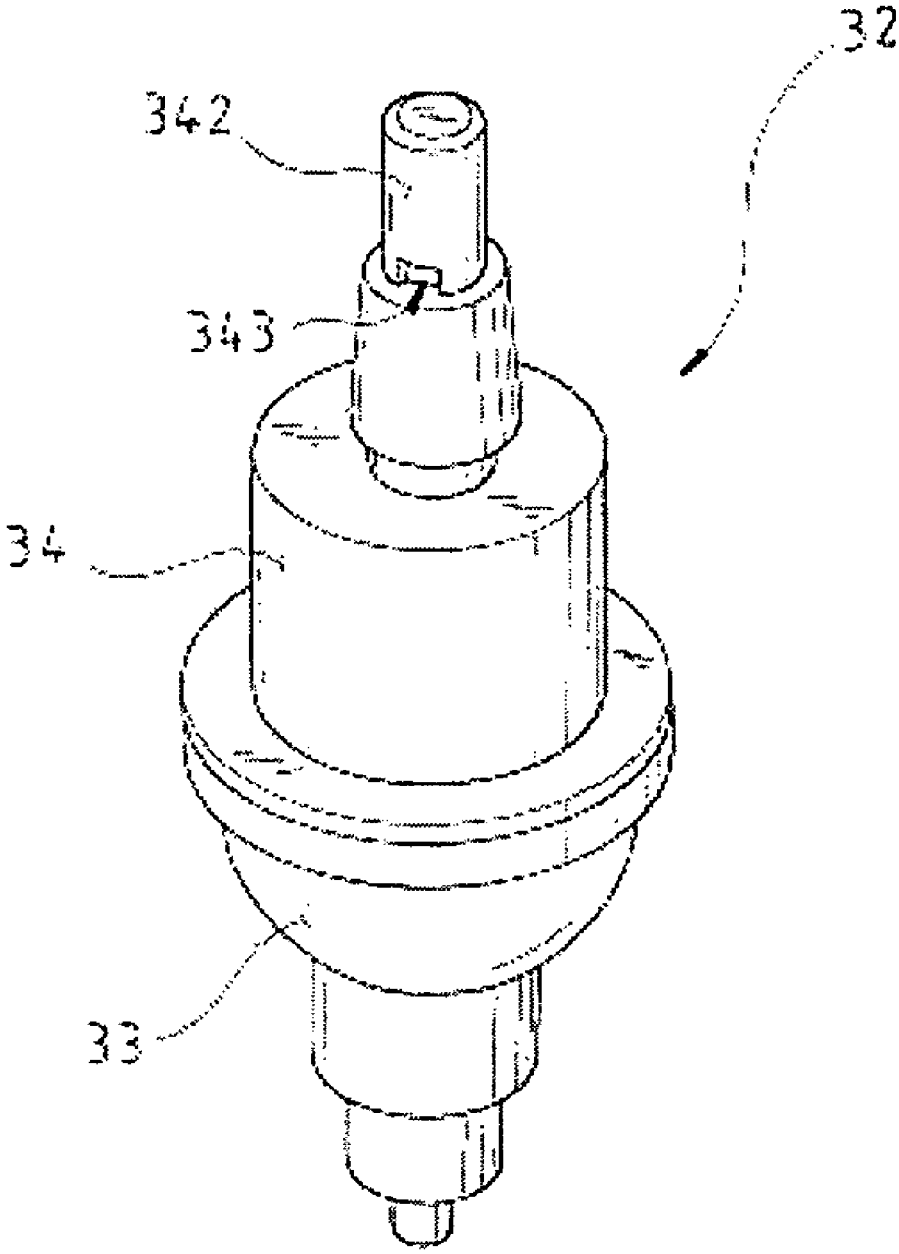
FIG. 5 is a perspective view of a control valve 32 in accordance with the present invention.
Figure 6:
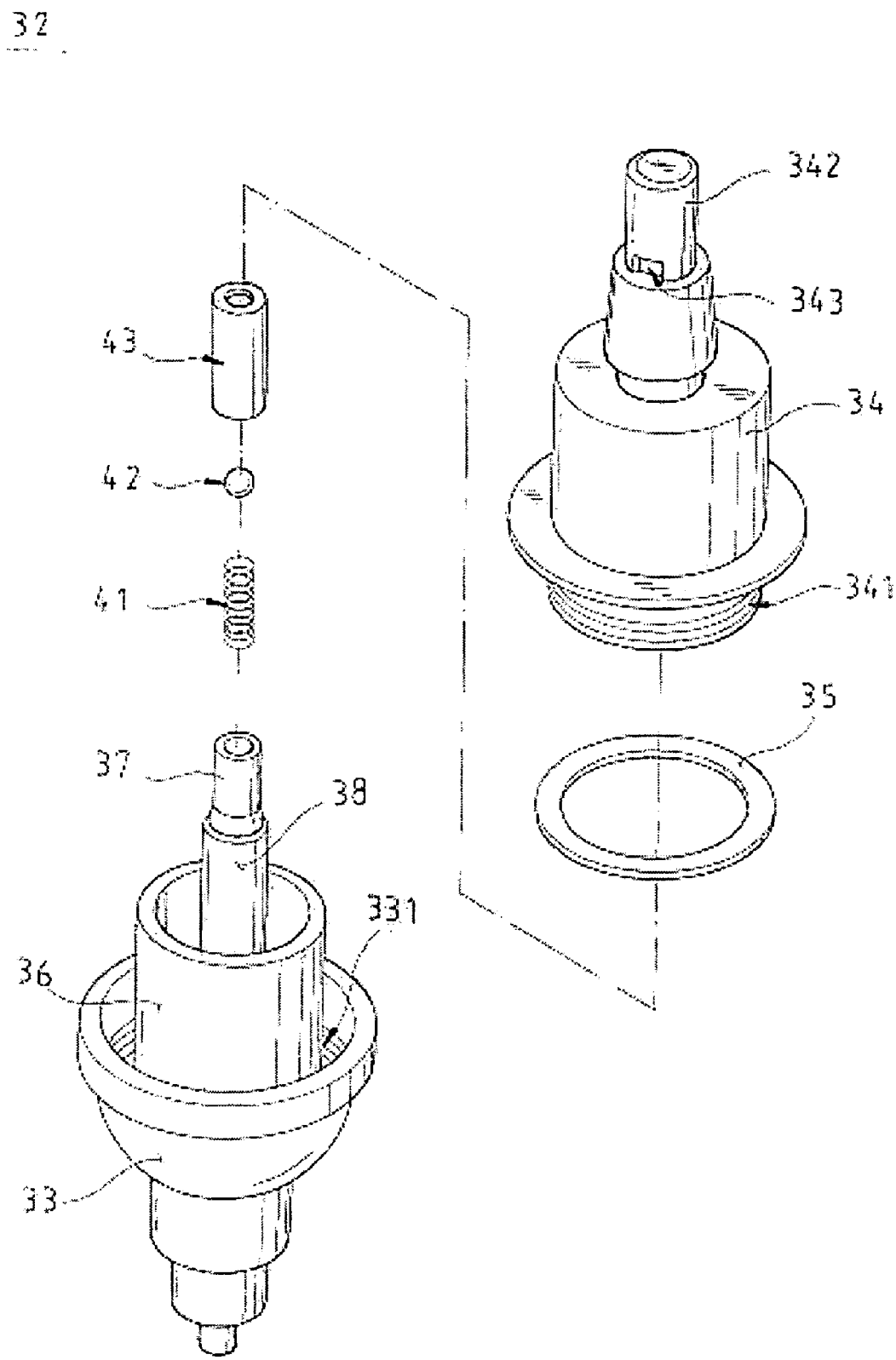
FIG. 6 is an exploded view of a control valve 32 in accordance with the present invention.

In a preferred embodiment of the present invention, the aforementioned components are assembled to form the improved assembly of a foam soap dispenser control valve, such that user can press the press plate 31 to squeeze an appropriate quantity of liquid hand soap as a foam out from a foam soap dispenser, such that the spring 41 in the protruding tube 37 will prop the steel ball 42 to move upward and force the steel ball 42 to abut tightly with the top of the protruding tube 37 and the internal side of the upper edge of the bushing 43 to prevent the liquid hand soap from flowing out. Now, the interior of the valve body 36 of the control valve 32 is substantially in a vacuum state, so that if the user releases the press plate 31, then the control valve 32 will resume its original position by the resilience of the spring, and the a suction force similar to the vacuum state is produced in the valve body 36 to draw out an appropriate quantity of liquid hand soap contained in the valve body 36. If the press plate 31 is not pressed, the spring 41 in the protruding tube 37 at the top of the valve body 36 will prop the steel ball 42 to move upward and force the steel ball 42 to abut tightly against the top of the protruding tube 37 and the internal side of the upper edge of the bushing 43, so as to achieve the effect of prevent an overflow of the liquid hand soap.

In summation of the description above, the present invention improves over the prior art, and complies with the requirements of patent application, and thus is duly filed for patent application.

While the invention has been described by means of specific embodiments, numerous modifications and variations could be made thereto by those skilled in the art without departing from the scope and spirit of the invention set forth in the claims.

What is claimed is:

1. An improved control valve for use in a foam soap dispenser, comprising:

a lower casing having a hollow cylindrical shape and an internal threaded section disposed on an internal side of an upper portion of the lower casing;

an upper casing having a hollow cylindrical shape and an external threaded section disposed on an external side of a lower portion of the upper casing threadedly engaged with the internal threaded section of the lower casing and a hollow joint bushing protruded from the top of the upper casing, the joint bushing having a closed end and a soap feeding inlet formed through a side of a bottom of the joint bushing; and a valve body disposed in the lower casing and having a hollow cylindrical shape, the valve body including:

an extending tube disposed at the middle of the valve body;

a protruding tube disposed at the top of the extending tube, a spring installed in the protruding tube;

a steel ball installed at an upper end of the spring;

a hollow bushing sheathed onto an external periphery of the protruding tube to retain the steel ball against a top of the protruding tube and an internal side of an upper edge of the bushing; and a leakproof washer sheathed onto a bottom of the external periphery of the valve body, wherein responsive to a press plate of a soap dispenser being displaced and a vacuum thereby being established within the valve body, the steel ball is moved away from the internal side of the upper edge of the bushing to permit soap to flow from the soap feeding inlet into the valve body, and upon release of the press plate of the soap dispenser, the spring biases the steel ball against the internal side of the upper edge of the bushing to stop the flow of soap and a suction force draws the liquid soap from the valve body.

* * * * *